United States Patent [19]

Madland

[11] 4,071,719

[45] Jan. 31, 1978

[54] KEYBOARD SWITCH ASSEMBLY HAVING ACTUATOR INTERLOCKING KEYBOARD SHIFT AND SHIFT LOCK AND RELEASE MECHANISM

[75] Inventor: Robert Christen Madland, Mount Prospect, Ill.

[73] Assignee: Illinois Tool Works Inc., Chicago, Ill.

[21] Appl. No.: 707,742

[22] Filed: July 22, 1976

[51] Int. Cl.[2] ..... H01H 3/20; H01H 9/20; G06C 7/02

[52] U.S. Cl. ..... 200/5 B; 200/5 E; 200/50 C; 197/98; 235/145 R

[58] Field of Search ..... 200/5 R, 5 B, 5 E, 5 EA, 200/50 C, 153 J, 159 R, 329, 330, 337, 340; 235/145 R, 145 A; 197/98

[56] References Cited

U.S. PATENT DOCUMENTS 3,715,023 2/1973 Jackson et al. ..... 235/145 R X 3,882,295 5/1975 Madland ..... 197/98 X

*Primary Examiner*—James R. Scott

*Attorney, Agent, or Firm*—Glenn W. Bowen; Robert W. Beart

[57] ABSTRACT

A keyboard shift and shift lock and release mechanism consisting of two shift keyswitches and one shift lock keyswitch is provided by the interaction of cams molded on the actuating plungers of the keyswitches and a slide member on each keyswitch which carries a cam follower pin and is constructed so as to move along a straight line relative to its associated housing upon actuation of the associated plunger. The two shift keyswitches have one type of cam and the slide members for these two switches are coupled together by a removable metal rod while the shift lock keyswitch has a second type of cam and its slide member interacts with the slide member of one of the shift keyswitches which is positioned adjacent to it.

13 Claims, 11 Drawing Figures

KEYBOARD SWITCH ASSEMBLY HAVING ACTUATOR INTERLOCKING KEYBOARD SHIFT AND SHIFT LOCK AND RELEASE MECHANISM

BACKGROUND OF THE INVENTION

Shift and shift lock and release mechanisms that are commonly employed on known keyboards are unduly complex and result in excessive manufacturing and assembly costs. The present invention provides a keyboard shift and shift lock and release mechanism which utilizes three keyswitches and the entire assembly is only slightly more expensive than the keyswitches themselves. Moreover, the assembly cost of the mechanism of this invention is essentially the same as the cost of inserting three standard keyswitches into the keyboard and, hence, it is minimal. These advantages flow from the simple, uncomplicated design of the present invention. In addition, the operating force for the shift and shift lock keyswitches of this keyboard is essentially the same as for any other keyswitch of the keyboard and, therefore, the excessive operating pressure which is commonly required to operate prior mechanisms of the described type is avoided by the improved design of the present invention.

The keyswitches of this invention have a cam formed on their actuating plunger which interact with the cam follower of a slide member on the housing of the associated keyswitch.

Another type of switch which utilizes a cam that is formed on a plunger and a slide member which carries a cam follower is shown in U.S. Pat. No. 3,882,295, issued in the name of Robert Christen Madland on May 6, 1975 and assigned to the assignee of the present invention. This type of switch, however, is not designed to provide or to be used with a keyboard shift and shift lock mechanism.

DESCRIPTION OF THE DRAWINGS

The present invention is shown by reference to the drawings in which.

TECHNICAL DESCRIPTION OF THE INVENTION

Figure 1:
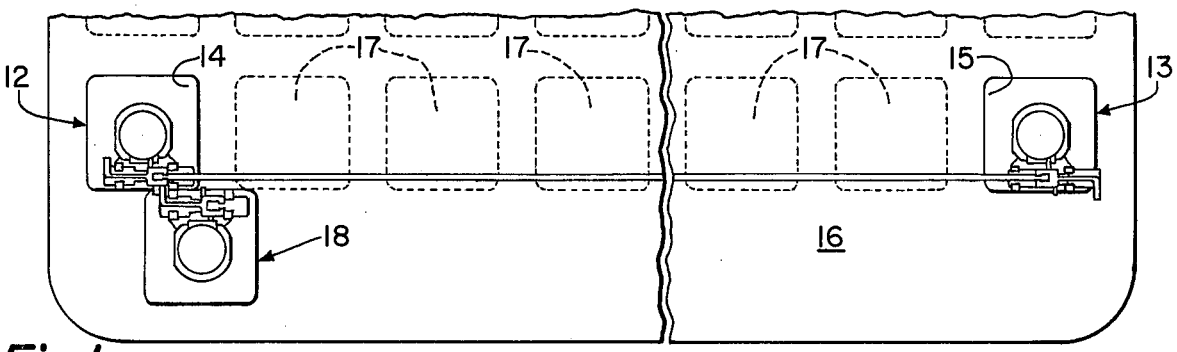
FIG. 1 is a partial top view of a keyboard which shows the two shift keyswitches, the shift lock keyswitch and the rod which links the two keyswitches when the keyswitches are inserted into the keyboard to form the shift and shift lock and release mechanism of the present invention.

The keyboard shift and shift lock release mechanism of the present invention may be implemented by use of a variety of different types of switches, including mechanical switches and contactless switches. One type of switch which is especially useful for a keyboard, constructed in accordance with the present invention, is shown in co-pending application Ser. No. 525,416, filed Nov. 20, 1974 in the name of Victor M. Bernin et al and assigned to the assignee of the present invention. In this type of switch, magnetic poles are positioned adjacent a saturable toroidal-shaped magnetic core, which is threaded by sense and drive wires, so as to saturate and unsaturate the core according to the position of the actuator. The particular type of switching mechanism that is employed, however, is not important for the present invention since it may be implemented using any type of suitable keyswitch.

The mechanism of the invention may employ one or two shift keyswitches 12, 13 which may be inserted into corresponding apertures 14, 15 at opposite ends of the keyboard 16. The option providing a shift release from either shift keyswitch is commonly referred to as a "Secretarial-Shift" and requires two shift keyswitches. The mechanism could also be utilized with only the shift lock keyswitch 18 and the adjacent shift keyswitch 12. Between the keyswitches 12, 13 there are other apertures 17 aligned in a row which may receive data of function keyswitches therein.

Figure 4:
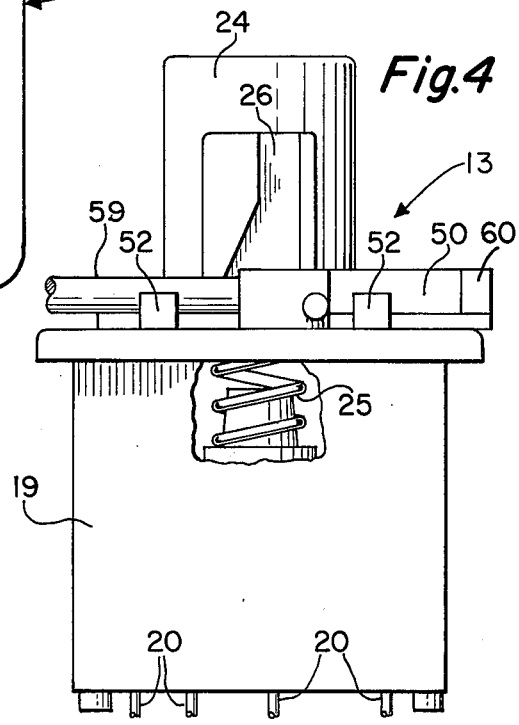
FIG. 4 is an enlarged side view partially broken open to show the return spring, of the right-hand shift keyswitch of FIGS. 1 and 2.

The switches 12, 13 and 18 each have a housing 19 which preferably is formed of plastic and which encloses any suitable known type of switching mechanism (not shown), such as the switch of the aforementioned Bernin et al application. The leads 20, which extend beyond the bottom of the housing 19, provide for interconnection to the switching mechanism. The upper surface 21 of the housing is formed with an integral boss 22 which has an aperture 23 in it which receives a depressible actuating plunger 24. A return spring 25, for returning the plunger to its initial position, is enclosed in the housing 19, as shown in FIG. 4.

Figure 5:
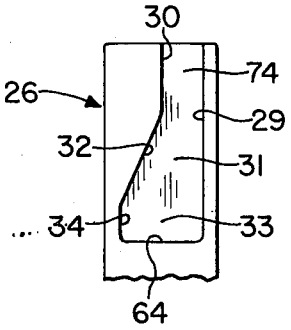
FIG. 5 is a diagrammatic representation of the cam portion of the actuating plungers of both of the shift keyswitches of FIGS. 1–4.

The actuating plungers 24 of the switches 12, 13 and 18 are also preferably formed of plastic, and they each have a cam formed in them as an integral part of the plunger. The configuration of the cams 26 of the shift keyswitches 12 and 13 is shown in FIG. 5. The cams 26 of both the shift keyswitches 12 and 13 face as shown in FIG. 5 when the switches are viewed along the viewing line represented by the arrows 27 of FIG. 2. The cam 26 is formed of a narrow upper portion 74 which is provided by a pair of parallel side walls 29, 30 which lead into an intermediate section 31 which is formed by the side wall 29 and an obliquely angled wall 32. The section 33 at the bottom of the cam 26 is formed by the side wall 29, the parallel side wall 34 and the horizontal bottom wall 64.

Figure 2:
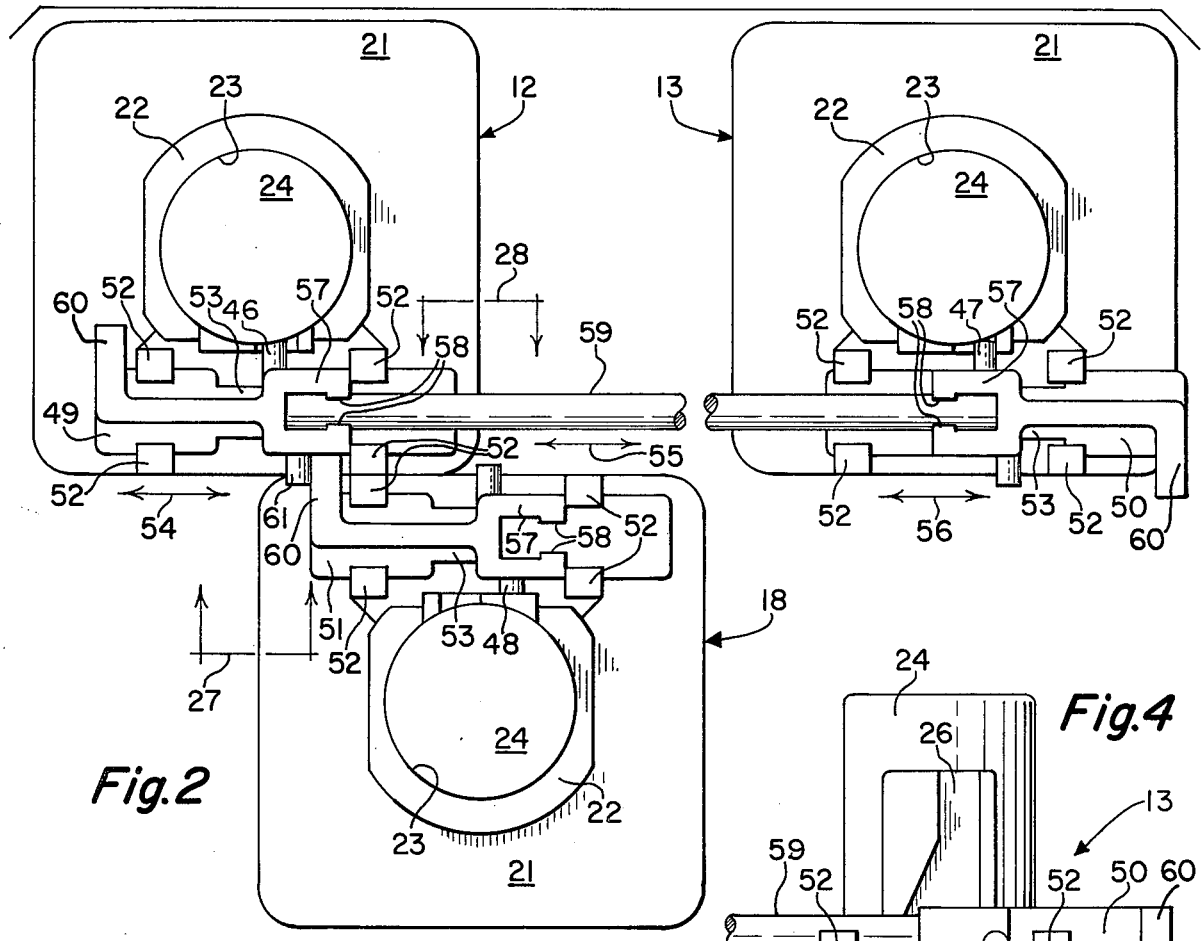
FIG. 2 is an enlarged top view that shows only the shift and shift lock keyswitches and a portion of the connecting rod of FIG. 1.
Figure 3:
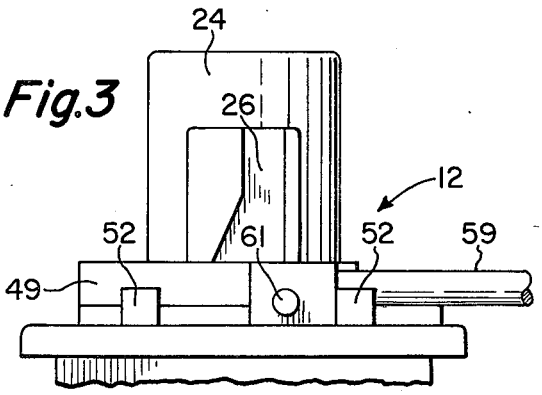
FIG. 3 is an enlarged partial side view showing of the actuating plunger and the slide member of the left-hand shift keyswitch of FIGS. 1 and 2, as viewed in the direction of the arrows associated with the Line 27 of FIG. 1.
Figure 6:
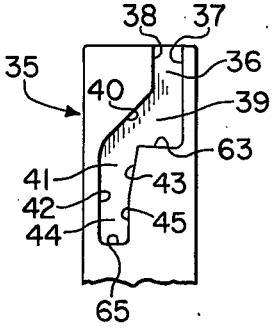
FIG. 6 is a diagrammatic showing of the cam portion of the actuating plunger of the shift lock keyswitch of FIGS. 1 and 2.

The cam 35 of the shift lock keyswitch 18 is shown in FIG. 6, as viewed along the viewing line represented by the arrows 28 of FIG. 2. This cam is formed of a narrow top section 36 which is provided by the parallel side walls 37 and 38. This leads into the intermediate wider section 39 which is formed by the side wall 37 and the obliquely angled wall 40 and the wall 63, which makes a small angle with the horizontal to encourage the follower to remain in the locked position. The next lower section is section 41 which is provided by the vertically extending substantially straight side wall 42 and the slightly angled side wall 43 on the right hand side of the cam. The bottom section 44 of the cam 35 is formed by the side wall 42, a substantially parallel vertical side wall 45 and a lower horizontal wall 65.

The cams 26 and 35 interact with the cylindrically shaped, inwardly extending cam follower pins 46, 47 and 48 of the slide members 49, 50 and 51, respectively, of their associated keyswitches. The slide members 49, 50 and 51 are retained on the top surfaces 21 of the housings 19 by four generally "L"-shaped retaining fingers 52. The slide members 49, 50 and 51 have sections 53 which are of a reduced dimension to allow these slide members to be easily positioned under the retaining fingers 52. The slide members 49 and 50, it will be noted, face each other and, hence, the cam follower pin 47 of the slide member 50 corresponds to the outwardly directed pin 61 of the slide member 49, which is offset slightly with respect to the pin 46, to locate the pins 46, 47 and 61 as desired. The slide members 49, 50 and 51 during operation of the inventive mechanism move back and forth in the direction indicated by the arrows 54, 55 and 56 along substantially a straight path on the outer surface of the housing of the associated keyswitch.

Figure 7:
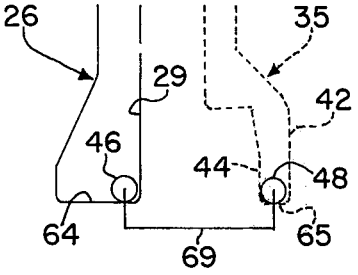
FIGS. 7–11 are a diagrammatic showing of how the interaction of the cam of the shift keyswitches and the shift lock keyswitch achieves the desired keyboard feature of this invention.

The operation of the shift and shift lock and release mechanism of the present invention is best shown by reference to FIGS. 7–11. In these figures, the cam 26 and the cam follower 46 of the left-hand keyswitch 12 and the cam 35 and the cam follower 48 of the shift lock keyswitch 18 are shown in diagrammatic form with the solid line 69 representing the interconnection provided by the slide members 49, 51. The outline of the cam 35 is shown in dotted lines since it is reversed in position with respect to the position shown in FIG. 6, where the viewing line for the cam is represented by the arrows 28. In FIG. 7, in other words, the cam is being viewed as if the switch 18 were transparent so that the cam 35 should be viewed along the viewing line represented by the arrows 27, because the operation of the switch is more easily understood when the cams 26, 35 are shown in this manner.

The slide members 49, 50 and 51 for the shift keyswitches 12, 13 and 18 each have a generally C-shaped end section 57. The end sections of the keyswitches 12 and 13 face each other and they have inwardly projecting gripping blocks 58 at the open end of the C-shaped section 57 so that they grip and hold into place a cylindrical, elongated, substantially straight rod 59 which is preferably made of metal and which serves to link the slide members 49 and 50 together.

The slide members 49, 50 and 51 also are formed to have an L-shaped arm 60 at their opposite ends. The L-shaped arm 60 may not be provided on all of the slide members, but for ease of manufacture, it is desirably included on each of the slide members. The L-shaped arm 60 for the slide member 51 contacts the cylindrically shaped pin 61 which is positioned slightly to the right of the cam follower pin 46 and which extends outwardly from the switch 12 toward the shift lock keyswitch 18 so that it abuts against the L-shaped arm 60 of the slide member 51 when both of the slide members 49 and 51 are positioned in their rightmost position, as shown in FIG. 2.

The initial positioning of the slide members 49 and 51 shown in FIG. 7, where the cam follower pin 46 of the slide member 49 is in contact with the wall 64 of the cam 26 and the cam follower pin 48 of the slide member 51 is in contact with wall 65, represents the situation where neither the shift keyswitches 12, 13 nor the shift lock keyswitch 18 is actuated. Since both of the slide members 49 and 51 are positioned to their rightmost position at this time, the slide member 50 will also be at its rightmost position due to the action of the linking rod 59. Therefore, the cam follower pin 47 of the slide member 50 will be located in the same relative position with respect to its cam 26 as is the cam follower pin 46 relative to its associated cam. The plunger of either of the shift keyswitches 12 or 13 may now be depressed, and the associated keyswitch will be actuated without any motion of the rod 59 occurring, so that the two keyswitches 12 and 13 may operate independently to provide shift pulses.

Figure 8:
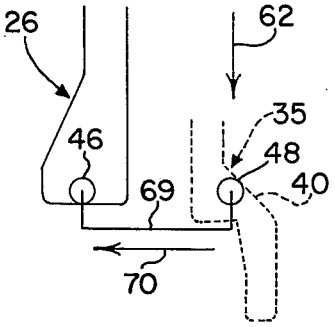
Figure 9:
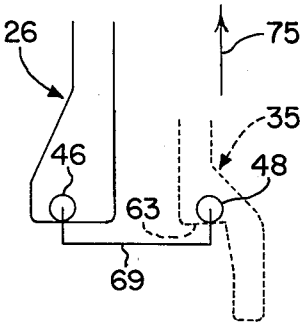
Figure 10:
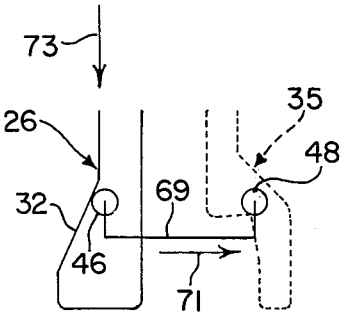

If the plunger 24 of the shift lock keyswitch 18 is now depressed, as represented by the arrow 62 in FIG. 8, the cam follower pin 48 of the slide member 51 will move up along the wall 42 and the wall 40 and to the left, as represented by the arrow 70, upon full depression of the plunger 24 to the position shown in FIG. 8. In this position the end of the C-shaped 57 of the slide member 50 will abut, and be stopped by, the left hand retaining fingers 52 on the housing of the shift keyswitch 13. Upon release of pressure on the plunger 24 of the shift lock keyswitch 18, it is forced upwardly, as represented by the arrow 75, by its associated spring 25 until the pin 48 comes into contact with the wall portion 63, as shown in FIG. 9, thereby locking the keyswitch 18 in an actuated condition. Shift signals will then be sent as long as the plunger of the shift keyswitch 18 is locked down. If the plunger of the left hand keyswitch is then depressed, as represented by the arrow 73, its associated cam follower pin 46 will be driven to the right, as represented by the arrow 71, due to the interaction of the pin 46 and its associated angled wall 32. The cam follower pin 48 of the slide member 51 is driven to the right due to the force exerted by the pin 61 of the slide member 49 which abuts the arm 60 of the slide member 51 as the slide member 49 moves to the right, thereby releasing the shift lock keyswitch from its locked state.

The rod 59 may be tightly coupled to the slide members 49 and 50 in a manner such that movement of the slide member 49 carries the rod 59 and the slide member 50 with it, or it may be loosely coupled so that it "floats" within the two slide members, due to the tolerances of the fit, so that the rod 59 can move within the C-shaped Section 57 of the slide member 49 when the plunger 24 of the left-hand shift keyswitch 12 is depressed, thereby allowing the slide member 49 to move enough to release the shift keyswitch 18 without substantial movement of the slide member 50 occuring. However, with either type of coupling, depression of the plunger of the right-hand keyswitch 13 causes the slide member 50 and the rod 59 to move so as to force the slide member 49 to the right, thereby releasing the plunger of the shift lock keyswitch 18 from its locked position.

Figure 11:
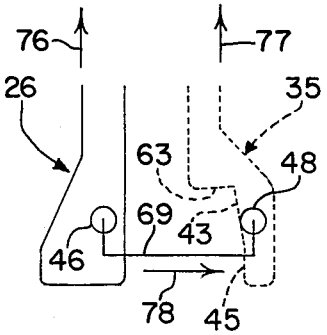

The locked state of the shift lock keyswitch 18 is thus released by the subsequent depression of either of the shift keyswitches 12, 13 since in either case the pin 48 will clear the wall 63 and pressure will be released on the plunger of the actuated shift keyswitch so that the plungers of the shift and shift lock keyswitches will both be forced to their initial positions by their respective springs 25, as represented by the arrows 76 and 77 of FIG. 11. The pin 48 travels along the angled wall 43 and the vertical wall 45, with a further slight movement to the right, as represented by the arrow 78, until both plungers are returned to their initial positions, and the pins 46 and 48 are returned to the initial position shown in FIG. 7.

The simple, reliable, easily assembled shift and shift lock and release mechanism of the present invention, in addition to having low manufacture and assembly costs, also is advantageous in that it features linkage which allows either shift keyswitch to be operated independently, and the linkage will not operate at all except when the shift lock keyswitch is in its locked mode. The operating force necessary to operate the shift and shift lock keyswitches of this invention are essentially the same as for any other keyswitch of the keyboard, and, thus, the keyboard of the present invention does not require the excessive force that was needed to operate many prior shift and shift lock keyboard mechanisms. The cam configuration of the shift lock keyswitch plunger also provides for positive return of its cam follower and slide member once they have been displaced to the release point, and the need for linkage return springs, which are common in prior keyboard shift and shift lock mechanisms, is thereby eliminated.

I claim:

1. A keyboard mechanism comprising a shift keyswitch and a shift lock keyswitch positioned adjacent said shift keyswitch wherein each of said keyswitches comprises a switching means, a housing for said switching means having an outer surface with an aperture therein, an actuating member having a cam associated therewith mounted for movement into said housing through said aperture from an initial undepressed position to a depressed position for actuating said switching means when said actuating member is in said depressed position, resilient means for returning said actuating member to its undepressed position and a slide member having a cam follower thereon which follows said cam wherein said slide member slides back and forth with respect to said outer surface, and wherein said mechanism further comprises a first engagement means on said slide member of said shift lock keyswitch and a second engagement means on said slide member of said shift keyswitch, which engages said first engagement means such that motion of one of said adjacent slide members causes a corresponding motion of the other of said adjacent slide members, said cam of said shift keyswitch being constructed to allow for independent depression of said actuating member of said shift keyswitch when said actuating member of said shift lock keyswitch is undepressed and said cam of said shift lock keyswitch being constructed so as to lock said actuating member of said shift lock keyswitch in a depressed position upon a first depression of said actuating member of said shift lock keyswitch so that said switching means of said shift lock keyswitch thereby is maintained actuated, said cams of said shift and shift lock keyswitches being further constructed such that a subsequent depression of said actuating member of said shift keyswitch causes said actuating member of said shift lock keyswitch to be released from its locked depressed position and returned to its initial position thereby deactuating said switching means of said shift lock keyswitch.

2. A keyboard mechanism as claimed in claim 1 wherein said first engagement means on said slide member of said shift lock keyswitch comprises an arm at one end thereof, and said second engagement means on said slide member of said adjacent shift keyswitch comprises an extending pin thereon which abuts said arm.

3. A keyboard mechanism as claimed in claim 1 wherein said slide members are elongated members formed of plastic material and said housing has a plurality of integrally formed, generally "L"-shaped returning fingers which extend from said housing and which retain said slide members on said outer surface thereof.

4. A keyboard mechanism as claimed in claim 3 wherein said first engagement means on said slide member of said shift lock keyswitch comprises an arm at one end thereof, and said second engagement means on said slide member of said adjacent shift keyswitch comprises an extending pin thereon which abuts said arm.

5. A keyboard mechanism comprising a pair of spaced-apart shift keyswitches and a shift lock keyswitch, one of said shift keyswitches being positioned adjacent said shift lock keyswitch and one of which is positioned remote from said shift lock keyswitch, wherein each of said shift and shift lock keyswitches comprises a switching means, a housing for said switching means having an outer surface with an aperture therein, an actuating member having a cam associated therewith mounted for movement into said housing through said aperture from an initial undepressed position to a depressed position for actuating said switching means when said actuating member is in said depressed position, resilient means for returning said actuating member to its undepressed position and a slide member having a cam follower thereon which follows said cam wherein said slide member slides back and forth with respect to said outer surface, and wherein said mechanism further comprises linkage means for linking together said slide members of said shift keyswitches, a first engagement means on said slide member of said shift lock keyswitch and second engagement means on said slide member of said adjacent shift keyswitch, which engages said first engagement means such that motion of one of said adjacent slide members causes a corresponding motion of the other of said adjacent slide members; said cams of shift keyswitches being constructed to allow for independent depression of either of said actuating members of said shift keyswitches when said actuating member of said shift lock keyswitch is undepressed and said cam of said shift lock keyswitch being constructed so as to lock said actuating member of said shift lock keyswitch in a depressed position upon a first depression of said actuating member of said shift lock keyswitch, thereby maintaining said switching means of said shift lock keyswitch actuated, said cams of said shift and shift lock keyswitches and said linkage means being further constructed such that a subsequent depression of said actuating member of either of said shift keyswitches causes said actuating member of said shift lock keyswitch to be released from its locked depressed position and returned to its initial undepressed position, thereby deactuating said switching means of said shift lock keyswitch.

6. A keyboard mechanism as claimed in claim 5 wherein said slide members are elongated members formed of plastic material and said housing has a plurality of integrally formed, generally "L"-shaped retaining fingers which extend from said housing and which retain said slide members on said outer surface thereof.

7. A keyboard mechanism as claimed in claim 5 wherein said first engagement means on said slide member of said shift lock keyswitch comprises an arm at one end thereof, and said second engagement means on said slide member of said adjacent shift keyswitch comprises an extending pin thereon which abuts said arm.

8. A keyboard mechanism as claimed in claim 7 wherein said slide members of said shift keyswitches are substantially identical and the location of said extending pin on said slide member of said adjacent shift keyswitch corresponds to the location of said cam follower on said slide member of said remote shift keyswitch.

9. A keyboard mechanism as claimed in claim 5 wherein said linkage means comprises an elongated, substantially straight rod that is coupled to said spaced-apart slide members of said shift keyswitches at its opposite ends.

10. A keyboard mechanism as claimed in claim 9 wherein linkage means further comprises a substantially C-shaped portion formed on each of said slide members which face each other and the ends of said rod reside in said C-shaped portions.

11. A keyboard mechanism as claimed in claim 10 wherein said first engagement means on said slide member of said shift lock keyswitch comprises an arm at one end thereof, and said second engagement means on said slide member of said adjacent shift keyswitch comprises an extending pin thereon which abuts said arm.

12. A keyboard mechanism as claimed in claim 11 wherein said slide members of said shift keyswitches are substantially identical and the location of said extending pin on said slide member of said adjacent shift keyswitch corresponds to the location of said cam follower on said slide member of said remote shift keyswitch.

13. A keyboard mechanism as claimed in claim 12 wherein said slide members are elongated members formed of plastic material and said housing has a plurality of integrally formed, generally "L"-shaped retaining fingers which extend from said housing and which retain said slide members on said outer surface thereof.

* * * * *